US006709499B2

(12) United States Patent
Moschütz

(10) Patent No.: US 6,709,499 B2
(45) Date of Patent: Mar. 23, 2004

(54) AIR-ROUTING HOUSEHOLD APPLIANCE WITH A WASHABLE FILTER

(75) Inventor: Harald Moschütz, Grossbeeren (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/320,951

(22) Filed: Dec. 16, 2002

(65) Prior Publication Data

US 2003/0089239 A1 May 15, 2003

Related U.S. Application Data

(63) Continuation of application No. PCT/EP01/06212, filed on May 31, 2001.

(30) Foreign Application Priority Data

Jun. 15, 2000 (DE) ..... 100 29 428

(51) Int. Cl.[7] ..... B01D 53/02

(52) U.S. Cl. ..... 96/153; 96/112; 96/115; 96/233; 55/385.1; 55/481; 55/482; 55/495; 55/506; 55/514; 55/524; 55/DIG. 31; 34/526; 34/549; 34/565; 34/73; 34/77; 34/80; 34/82

(58) Field of Search ..... 55/385.1, 481, 55/482, 495, 501, 503, 505, 506, 509, 514, 524, 527, 528, DIG. 31; 96/153, 233, 112, 115; 34/524, 526, 543, 549, 553, 565, 72, 77, 73, 75, 80, 82, 132, 595, 608, 606, 507

(56) References Cited

U.S. PATENT DOCUMENTS

| | | | | | |
|---|---|---|---|---|---|
| 4,510,193 | A | * | 4/1985 | Blucher et al. | 55/524 |
| 4,621,438 | A | * | 11/1986 | Lanciaux | 34/77 |
| 5,350,443 | A | * | 9/1994 | von Blucher et al. | 55/524 |
| 5,367,787 | A | * | 11/1994 | Ikeda et al. | 34/549 |
| 5,546,678 | A | * | 8/1996 | Dhaemers | 34/74 |
| 5,682,684 | A | * | 11/1997 | Wentzlaff et al. | 34/524 |
| 5,783,080 | A | * | 7/1998 | Hsieh | 55/524 |
| 5,807,424 | A | * | 9/1998 | de Ruiter et al. | 55/524 |
| 6,134,806 | A | * | 10/2000 | Dhaemers | 34/404 |
| 6,158,148 | A | * | 12/2000 | Krausch | 34/549 |
| 6,447,584 | B1 | * | 9/2002 | Kishkovich et al. | 96/153 |
| 2003/0014880 | A1 | * | 1/2003 | Baurmann | 34/595 |

FOREIGN PATENT DOCUMENTS

| | | | |
|---|---|---|---|
| DE | 34 12 284 | A1 | 10/1985 |
| DE | 195 21 665 | A1 | 1/1996 |
| DE | 695 11 858 | T2 | 3/1997 |
| DE | 196 17 753 | A1 | 11/1997 |
| DE | 197 05 616 | A1 * | 8/1998 |
| DE | 197 48 706 | A1 | 5/1999 |
| EP | 0 759 721 | B1 | 3/1997 |
| GB | 2 307 399 | A | 5/1997 |
| JP | 04 090795 | | 3/1992 |

* cited by examiner

*Primary Examiner*—Duane Smith
*Assistant Examiner*—Jason M. Greene
(74) *Attorney, Agent, or Firm*—Laurence A. Greenberg; Werner H. Stemer; Ralph E. Locher

(57) ABSTRACT

An air-routing household appliance includes an improved removable and washable filter in that the filter is of a flexible fiber material and is finished such that it can bind and/or decompose odorous substances. Such a filter can be disposed, in particular, in the closed process-air circuit of a condensation laundry dryer to free laundry of unpleasant odorous substances. The odor filter is produced, in particular, from a textile material and can, therefore, advantageously be cleaned in a washing machine. For the binding of odorous substances, the fibers of the filter can be treated with particles that can bind odorous substances and from which the odorous substances can also be washed out again to regenerate the filter.

16 Claims, 1 Drawing Sheet

AIR-ROUTING HOUSEHOLD APPLIANCE WITH A WASHABLE FILTER

CROSS-REFERENCE TO RELATED APPLICATION

This application is a continuation of copending International Application No. PCT/EP01/06212, filed May 31, 2001, which designated the United States and was not published in English.

BACKGROUND OF THE INVENTION

Field of the Invention

The invention relates to an air-routing household appliance with a removable and washable filter disposed in the air stream.

German Published, Non-Prosecuted Patent Application DE 197 05 616 A1 discloses a laundry dryer in which a first lint filter is followed by a second, finer, deep-bed filter that can be cleaned under flowing water. The deep-bed filter is produced from foam material and, therefore, has to be cleaned carefully. Furthermore, the action of the deep-bed filter amounts to no more than an improved filter action in respect of the lints entrained in the air stream.

SUMMARY OF THE INVENTION

It is accordingly an object of the invention to provide an air-routing household appliance with a washable filter that overcomes the hereinafore-mentioned disadvantages of the heretofore-known devices of this general type and that has an air filter of broadened functionality that, moreover, can be cleaned more effectively.

With the foregoing and other objects in view, there is provided, in accordance with the invention, a condensation laundry dryer, including a closed process-air circuit in which process air is circulated, a heating device disposed in the process-air circuit for heating the process air, a cooling device disposed in the process-air circuit for cooling moisture-laden process air, and a removable washable filter disposed in the process-air circuit for at least one of binding and decomposing odorous substances located in the process air, the washable filter having a flexible fiber material.

According to the invention, the filter is of a flexible fiber material and is finished such that it can bind and/or decompose odorous substances. The flexible fiber material ensures a mechanical resistance of the filter that allows thorough cleaning, particularly in a washing machine. The filter can, thus, be washed with a high introduction of mechanical energy and also at high temperatures. The precondition for filter treatment is, thereby, also afforded, making it possible to clean and/or regenerate odor filters to a sufficient extent.

The fiber material can be treated with particles of a material that can bind odorous substances and from which the odorous substances can also be washed out again. These particles may be activated charcoal, or special minerals. A treatment of the fiber material with catalytically acting materials that can decompose odorous substances may also be envisaged.

In accordance with another feature of the invention, advantageously, the filter has no hard components. As a result, it can also be washed in a household washing machine in the same way as completely normal laundry, without the risk of the washing machine being damaged.

In accordance with a further feature of the invention, the filter may be of a sheet-like piece of fibrous nonwoven, fibrous woven fabric, or fibrous knitted fabric, the household appliance having a receptacle for holding and tension-mounting the filter within the air stream. The filter may, in such a case, be of a portion of a filter material capable of being manufactured in a string so that it can be made available in a highly cost-effective way. The receptacle for the filter is, advantageously, removable from the household appliance to make it easier to insert and extract the filter.

In accordance with an added feature of the invention, the filter may be preceded by a coarse filter for removing particles from the air stream. The filter can, thus, be protected against coarse particles that could clog it or be detrimental to its action.

In accordance with a concomitant feature of the invention, the coarse filter is a lint filter.

Advantageously, the invention is used in a condensation laundry dryer, in which process air is circulated in a closed circuit and in the process-air circuit of which are disposed a heating device for heating the process air, a cooling device for cooling moisture-laden process air, the filter, and a preceding lint filter as the coarse filter. In such an application, account can be taken of a frequent requirement of users that is aimed at freeing the laundry of unpleasant odorous substances. This may arise when the garment has been exposed to cigarette smoke and merely an airing of the garment is desired. The odor filter is, advantageously, disposed, within the process-air circuit, at the point at which the best conditions for removing the odorous substances from the process air prevail. Thus, for example, in the section between the cooling device and heating device, the temperature of the process air is the lowest and the relative atmospheric moisture is the highest, and, downstream of the heating device and before contact with the laundry to be dried, the temperature is the highest and the relative atmospheric moisture the lowest.

A control device of the condensation laundry dryer may, advantageously, be set up such that the process air can be heated to a temperature below that normally used for laundry drying and can be circulated. Thus, the laundry can be treated more carefully and, nevertheless, aired, while energy can also be saved due to the reduced temperature. Furthermore, the control device may be set up such that the process air can be circulated even with the cooling device switched off. Cooling of the process air is not necessary during airing because no moisture has to be removed from the process air and, therefore, further energy can be saved.

Further applications of the invention are, for example, vapor extraction hoods, vacuum cleaners, and heating fans.

Other features that are considered as characteristic for the invention are set forth in the appended claims.

Although the invention is illustrated and described herein as embodied in an air-routing household appliance with a washable filter, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
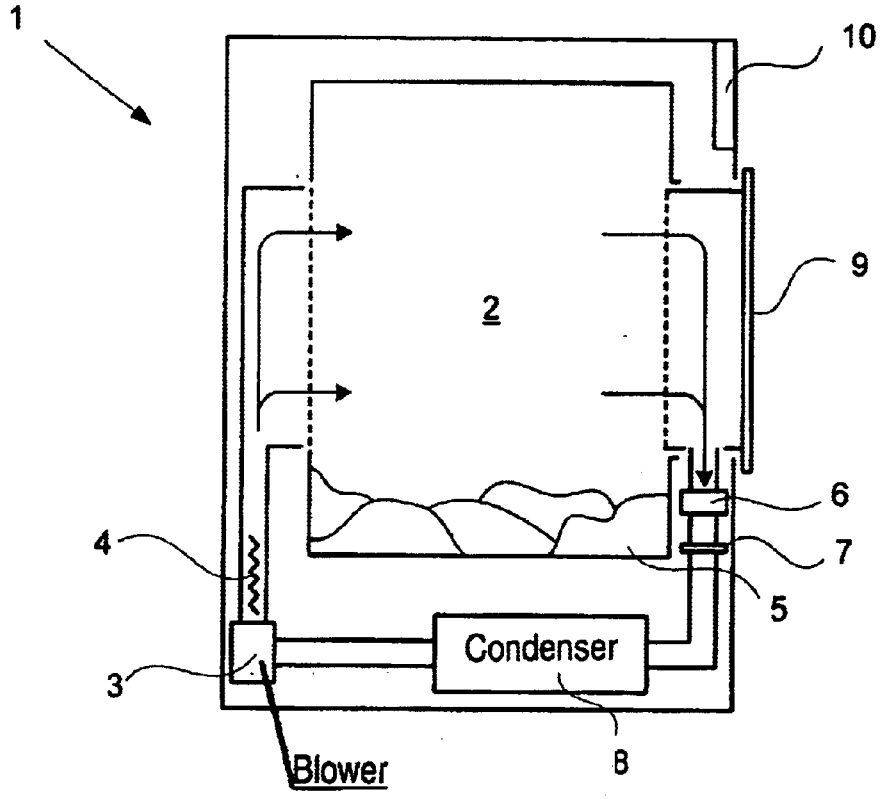
FIG. 1 is a diagrammatic cross-sectional view of a laundry dryer according to the invention.

Referring now to the figures of the drawings in detail and first, particularly to FIG. 1 thereof, there is shown a household laundry dryer 1 having a rotatably mounted drum 2 for receiving the laundry 5 to be dried. The drum 2 has a perforated drum bottom and, on the opposite side, a loading orifice that can be closed by a door 9 articulated on the housing of the household laundry dryer 1. During operation, a blower 3 generates a dry-air stream that is led to a heating device 4 and, subsequently, through the perforated drum bottom into the drum 2. After contact with the laundry 5, the dry air flows first through the door 9, a coarse lint filter 6 and, subsequently, the odor filter 13 held in a receptacle 7. Thereafter, the dry air is led to a condenser 8, in which the dry air is cooled for the condensation of laundry moisture contained in it. For such a purpose, the condenser 8 has flowing through it cooling air that is drawn in from the surroundings of the household laundry dryer 1. After flowing through the condenser 8, the dry air is drawn in again by the blower 3.

Figure 2:
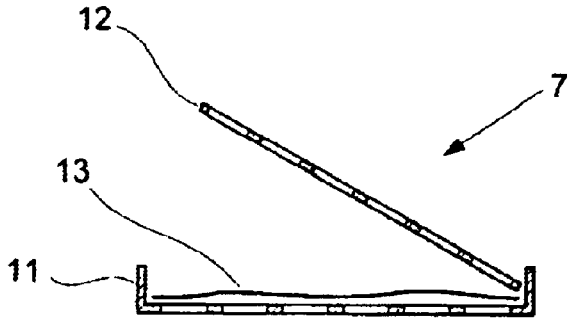
FIG. 2 is a cross-sectional view of a receptacle for the odor filter according to the invention.

The receptacle 7 in FIG. 2 serves as a holding frame for the odor filter 13. For such a purpose, the holding frame 7 has a sheet-like tray-shaped lower part 11, the bottom of which has large orifices for the passage of the process air. A foldable upper part 12 can be folded down onto the lower part 11 and locked, the upper part 12 being capable of covering substantially the entire bottom of the lower part 11 and having orifices that, in the folded-down state, come to lie in each case over the orifices in the lower part 11. An odor filter 13 in the form of a piece of textile material can be retained between the lower part 11 and the upper part 12. For such a purpose, the odor filter 13 is treated with a substance that can bind odorous substances and from which the odorous substances can also be washed out again in order to regenerate the odor filter 13 and, thus, make it suitable for permanent use. The odor filter 13 has no hard components of any kind and can, therefore, be washed in a washing machine in the same way as normal laundry.

The receptacle 7 can be disposed from outside, in particular, through a special flap, in the process-air circuit of the laundry dryer 1 and can be extracted from the latter.

The laundry dryer 1 illustrated in FIG. 1 additionally has a control device 10 for activating the blower 3 of the heating device 4 and a further non-illustrated blower that can supply the condenser 8 with cooling air. The control device 10 is set up such that, in a program for airing the laundry 5, the process air can be circulated at a reduced temperature, with the drum 2 rotating, the blower for the condenser 8 being switched off so as not to cool the process air unnecessarily. In such a case, as well as the normal drying program, the movement of the laundry drum 2 can also be reduced in addition to the temperature of the process air or the heating capacity of the heating device 4.

I claim:

1. A condensation laundry dryer, comprising:

a closed process-air circuit in which process air is circulated;

a heating device disposed in said process-air circuit for heating the process air;

a cooling device disposed in said process-air circuit for cooling moisture-laden process air; and a removable washable filter disposed in said process-air circuit for at least one of binding and decomposing odorous substances located in the process air, said washable filter having a flexible fiber material.

2. The condensation laundry dryer according to claim 1, wherein said washable filter has no hard components to damage a washing machine during washing of said washable filter in the washing machine.

3. The condensation laundry dryer according to claim 1, wherein said washable filter has only soft components to protect a washing machine from damage during washing of said washable filter.

4. The condensation laundry dryer according to claim 1, wherein said washable filter is of components that do not damage a washing machine during washing of said washable filter.

5. The condensation laundry dryer according to claim 1, wherein:

said washable filter is of a sheet-shaped piece of at least one of fibrous nonwoven, fibrous woven fabric, and fibrous knitted fabric; and a receptacle holds and tension-mounts said washable filter within a stream of the process-air.

6. The condensation laundry dryer according to claim 5, wherein said receptacle is removable from the condensation laundry dryer.

7. The condensation laundry dryer according to claim 5, wherein said receptacle is removable from said process-air circuit.

8. The condensation laundry dryer according to claim 1, wherein:

said process-air circuit circulates the process air in a circulation direction; and a coarse filter is disposed upstream of said washable filter with respect to said circulation direction for removing particles from the air stream.

9. The condensation laundry dryer according to claim 8, wherein said coarse filter is a lint filter.

10. The condensation laundry dryer according to claim 1, including a control device connected to said heating device, said control device controlling circulation of the process air and controlling heating of the process air to a temperature below a temperature used for laundry drying.

11. The condensation laundry dryer according to claim 1, including a control device connected to said heating device, said control device controlling heating of the process air to a temperature below a temperature used for laundry drying while circulating the heated process air.

12. The condensation laundry dryer according to claim 1, including a control device controlling circulation and heating of the process air to a temperature below a temperature used for laundry drying.

13. The condensation laundry dryer according to claim 1, including a control device programmed to circulate the process air when said cooling device is switched off.

14. The condensation laundry dryer according to claim 1, including a control device connected to said cooling device, said control device being programmed to selectively circulate the process air when said cooling device is switched off.

15. The condensation laundry dryer according to claim 1, including a control device connected to said cooling device, said control device being programmed to circulate the process air at some times when said cooling device is switched off.

16. The condensation laundry dryer according to claim 1, including a control device connected to said cooling device, said control device being programmed to circulate the process air with said cooling device switched off.

* * * * *